US008414071B2

(12) United States Patent
Rabson et al.

(10) Patent No.: US 8,414,071 B2
(45) Date of Patent: Apr. 9, 2013

(54) PROTECTIVE SEAT COVERS FOR UPHOLSTERY AND METHODS OF USE

(75) Inventors: Rebecca Rabson, Newton, MA (US); Jeremy Rabson, Newton, MA (US); Daryl Twitchell, New Canaan, CT (US); Birgit Leitner, Warwick, RI (US)

(73) Assignee: pb&j Discoveries, LLC, Newton, MA (US)

( * ) Notice: Subject to any disclaimer, the term of this patent is extended or adjusted under 35 U.S.C. 154(b) by 66 days.

(21) Appl. No.: 13/099,413

(22) Filed: May 3, 2011

(65) Prior Publication Data

US 2011/0272981 A1 Nov. 10, 2011

Related U.S. Application Data

(60) Provisional application No. 61/395,149, filed on May 10, 2010.

(51) Int. Cl.
*A47C 31/00* (2006.01)

(52) U.S. Cl.
USPC ..... 297/228.12; 297/DIG. 6; 297/463.2

(58) Field of Classification Search ..... 297/228.12, 297/228.13, 219.1, DIG. 6, 218.3, 218.5, 297/446.2, 218.1, 463.2
See application file for complete search history.

(56) References Cited

U.S. PATENT DOCUMENTS

| | | | | |
|---|---|---|---|---|
| 1,005,330 | A * | 10/1911 | Schmits et al. | 297/250.1 |
| 1,729,352 | A * | 9/1929 | McGinnis et al. | 297/228.12 |
| 2,205,302 | A * | 6/1940 | Morgenstern | 297/228.12 |
| 2,734,543 | A * | 2/1956 | Hunter | 206/439 |
| 3,243,827 | A * | 4/1966 | Kintner | 5/496 |
| 3,245,382 | A * | 4/1966 | Easley et al. | 297/485 |
| 5,028,472 | A * | 7/1991 | Gray | 428/100 |
| 6,175,980 | B1 * | 1/2001 | Gaither | 5/654 |
| 6,648,410 | B2 * | 11/2003 | Sparks | 297/228.12 |
| 2007/0145798 | A1 * | 6/2007 | Nadler-Sachs | 297/228.1 |

* cited by examiner

*Primary Examiner* — Milton Nelson, Jr.
(74) *Attorney, Agent, or Firm* — Charlton Shen

(57) ABSTRACT

Seat covers for protecting furniture such as upholstered chairs and methods of their use are disclosed in the present application. In some instances, the seat covers are designed to provide resistance to water and other liquids, while providing an attractive, binding, protective cover that is both aesthetically pleasing and comfortable. The seat covers can include a liquid-resistant, soft to the touch, fabric and straps oriented at corners with connectors for allowing the straps to connect with one another without the need to tie straps to one another or to a chair leg. The length of the straps and the shape of the fabric area can also be configured to provide additional functionalities which are advantageous relative to previous seat covers. Methods of using seat covers are also disclosed.

23 Claims, 4 Drawing Sheets

PROTECTIVE SEAT COVERS FOR UPHOLSTERY AND METHODS OF USE

CROSS REFERENCE TO RELATED APPLICATIONS

The present application claims the benefit of a U.S. Provisional Patent Application entitled "A reusable, washable, fluid-proof and non-slip protective seat cover for use on upholstered chairs utilizing a unique trapezoid shape and four webbing straps with an adjustable-length fastening system, such as hook and loop, that is designed to accommodate a broad range of chair shapes and sizes," bearing Ser. No. 61/395,149, filed on May 10, 2010, the entire contents of which are hereby incorporated by reference herein.

FIELD OF THE APPLICATION

The technical field of the present application is directed generally to protective covers, which can be capable of protecting upholstered furniture from fluids, stains, and debris, and methods related to their use.

BACKGROUND

Upholstered chairs with a fabric based seat cushion, such as dining room chairs, are popular because of their comfort and style. The fabric-covered cushion, however, can be difficult to clean, easily stain, and become unsightly, or even unsanitary, without proper protection. Young children are notoriously messy eaters. They spill fluids, drop food, and wipe their hands on whatever is close by, including chair upholstery. They also are careless with art supplies, such as markers, pens, crayons, paint, and glue. Additionally, some elderly suffer from incontinence, leading to urinary accidents while sitting on fabric cushioned chairs. Moreover, some people like to protect their upholstered furniture from everyday wear and tear. While a number of covers for protecting upholstery cushions exist in the art, they are not satisfactory in addressing many of the concerns facing their use. Accordingly, a need persists for devices and methods of protecting upholstered chairs.

SUMMARY

Some aspects of the invention are directed to seat covers that can be used to protect an upholstered seat of a chair. The seat cover can include a liquid-resistant, four-sided, fabric sheet having an area sufficient to substantially cover a seat area of a cushion of the upholstered chair. The fabric sheet can be constructed from a non-vinyl material. Four or more straps can be attached to the sheet; each of the straps can have a free end. The sheet can be configured to be stretched over the cushion when each of the at least four straps are attached to at least one other strap in tension. In some embodiments, each of the straps can be aligned with a corner of the sheet, the corner being adjacent to two other corners. Alternatively or in addition, each of the at least four straps can have a connector adapted to connect to another connector of a strap at one adjacent corner, and/or not to connect to another connector of a strap located at another adjacent corner. One or more of the straps can include a hook and loop connector (e.g., Velcro®).

In some embodiments, the straps of the seat cover include at least two longer straps aligned at adjacent corners of the sheet, and at least two shorter straps aligned at adjacent corners of the sheet. The two longer straps can be configured to each attach only to one of the shorter straps, or to any of the straps. In other embodiments, the fabric sheet can include a trapezoidal shape having a shorter side and a longer side. When utilized with the shorter and longer straps, the two shorter straps can be aligned with corners of the longer side of the trapezoidal shape. In other embodiments, each of a number of straps can be oriented at a corner of the fabric cover, and/or be oriented so that the strap is not aligned with a side of the fabric sheet (e.g., does not extend in a straight line parallel with, or collinear with, the side of the fabric).

Other aspects of the invention are directed to a protected cushion of an upholstered chair, in which the cushion can be covered at least in part by a seat cover as described in the present application. In some embodiments, the upholstered chair includes a back support, a pair of back legs each elongatedly aligned with a side of the back support, and a pair of front legs. In other embodiments, a seat cover with at least two longer straps are each wrapped outside of a back leg of the chair, and at least two shorter straps are each extended between the front legs of the chair.

Additional aspects of the invention are directed to methods of protecting an upholstered seat of a chair. The chair can be one that includes a back support, a pair of back legs each elongatedly aligned with a side of the back support, and a pair of front legs. A seat cover can be provided, which can be consistent with any of the embodiments described herein. The straps of the seat cover can be positioned under the upholstered seat of the chair. For instance, the two or more of the straps can be wrapped around the outside a corresponding back leg of the chair, and/or two or more straps can be extended between the front legs of the chair. Each strap can be attached to one or more of the other straps using a connector associated with each attached strap. Strap(s) can also be adjusted so that they are in tension when they are attached to one or more other straps. These methods can result in a fabric being stretched over the cushion of the upholstered seat to hinder relative movement between the fabric and cushion when a person is seated on the fabric and cushion.

A variety of variations on the methods can be implemented within the scope of the invention. In some embodiments, the order of the steps of the method can be altered in any potential permutation. For instance, the attachment of straps and adjustment of tension can occur with the attachment occurring before, after, or substantially simultaneously as the adjusting. In some embodiments, when a trapezoidal shaped fabric is utilized, the shorter side of the shape is aligned with the side of the chair having the back legs.

BRIEF DESCRIPTION OF THE DRAWINGS

Aspects of the present invention will be more fully understood from the following detailed description taken in conjunction with the accompanying drawings (not necessarily drawn to scale), in which.

DETAILED DESCRIPTION

Figure 1:
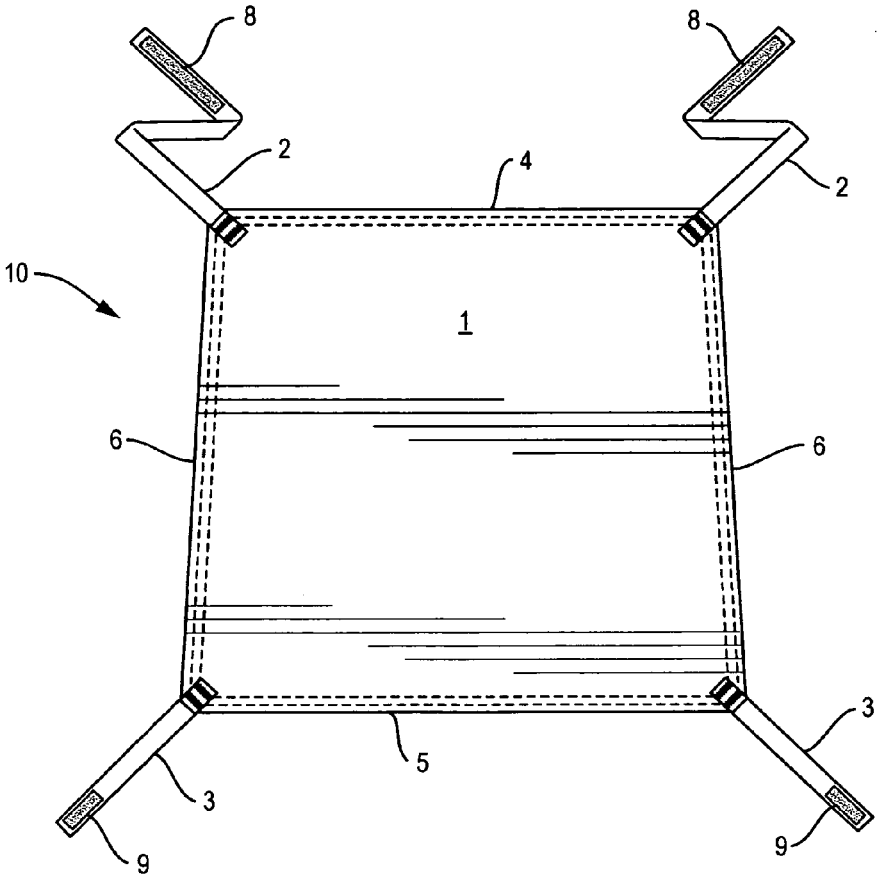
FIG. 1 is schematic view of a seat cover consistent with some embodiments of the present invention.

Embodiments of the present invention can be directed to seat covers for protecting the seat cushion of an upholstered chair, and methods of their use. While covers exist in the art for protecting chairs, such covers suffer from a number of disadvantages.

There are two basic types of existing covers: those made from vinyl and those made from cloth or another type of fabric (i.e., a material made at least in part from a matting of fibers that can be woven and/or non-woven that exhibits drape). The vinyl covers, and other similar covers made from a non-fabric, plastic material, are a square of clear, transparent plastic film that is placed upon the seat cushion of a chair and attached to the chair legs with vinyl strips that are each tied to the chair legs. Cloth covers can be similarly shaped. As well, cloth covers—like slipcovers that can bag and do not grip the seating area, which are designed to envelop an entire chair, including a chair back—tend to be decorative and can significantly alter the appearance of the chair.

There are several problems with these previous designs. The vinyl covers, while offering some protection against stains, do not stay in place well. They slide back and forth on the chair, exposing the cushion of the seat to stains and also making them unsafe for younger children or the elderly who could topple off the chair if a vinyl cover unexpectedly shifts beneath them. Vinyl covers also use ties, the purpose of which is to secure the cover to the chair legs. These ties, however, come untied quite easily and, therefore, do not adequately secure the vinyl cover to the chair and are not an effective means for keeping the cover in place. The use of ties as a securing mechanism also makes these covers unusable on a variety of chair styles, including the "Pullman" style chair that has a solid back, or chairs with very wide legs around which the ties cannot be secured. Additionally, vinyl is an uncomfortable material to sit on. It makes noise when the person sitting on it moves around. It sticks to bare skin, making it unpleasant to sit on in shorts or shorter skirts. It also can be slippery when one is wearing long pants or skirts, making it unsafe for young children who may kneel or stand in socks on chair seats. As well, the vinyl/plastic, covers change the appearance of the cushion substantially, making them substantially less attractive.

Cloth covers are also ineffective. Unless they are lined with a fluid-proof material, cloth covers do not prevent fluid leaks or stains resulting from spills. Cloth covers also tend to be made from decorative textiles that dramatically change the appearance or aesthetic look of the chair.

Finally, both vinyl and cloth covers commonly do not fit snuggly around the seat of the chair and tend to look untailored and messy. This poor fit also contributes to dangerous slipping and sliding of the cover mentioned above.

Embodiments of the invention can address one or more of these problems and disadvantages of previous seat covers. This will be described in reference to the embodiments described herein. It should be understood that the descriptions and depictions of embodiments explicitly described herein are not meant to be limiting. That is, it is understood that other embodiments of the invention include instances that utilize any possible combination of the features in the particular embodiments explicitly described herein. Accordingly, the invention should only be limited with respect to the patented claims.

Seat Covers

Some embodiments of the invention are directed toward seat covers that are designed to protect an upholstered seat of a chair such as a dining room chair or some other type of chair (e.g., four-legged chair). In some instances, the seat cover lacks a structure for substantially covering a seat back of an upholstered chair (e.g., lacks a section that wraps around a seat back or slips over the top of a seat back). The seat cover can include a liquid-resistant fabric (e.g., a sheet of material) that can have an area sufficient to cover the seat area of the cushion of the chair. For instance, the area of the fabric can be sufficient to cover not only the top seating area of the upholstered seat but the three or four exposed sides of the cushion as well. The cover also includes a plurality of straps that are attached to the fabric, for example at least four straps, that each have an end that can be free. Each of the straps can include a connector that can allow a strap to be connected to another strap (e.g., without the need for a strap to be tied to another strap and/or to the connector). One particular embodiment of the invention showing some features described in the present application is depicted in FIG. 1. The seat cover 10 is shown with a fabric sheet 1 and four straps 2, 3. The straps 2, 3 each include a connector that is embodied as a hook and loop (e.g., Velcro®) connector 8, 9, respectively, in this particular embodiment.

The fabric sheet of a seat cover can be made of any type of suitable fabric including a liquid-resistant fabric to help hinder liquid penetration or staining of the cover by water and/or other fluids. In some embodiments, vinyl and other plastic based sheets are avoided as the sole sheet material to help enhance the appearance of the cover. As well, sheet materials that have the ability to stretch to some degree can be advantageous to help the cover tightly adhere to a cushion when the straps are tightened. This can help form a cover that conforms with a cushion's shape, and give it a better appearance, and/or prevent the cover from slipping relative to the cushion surface. Fabric materials can include composite materials that have a cloth-like feel layer and a liquid repelling layer sandwiched together with the cloth-like feel layer intended to be oriented on the exterior surface when the cover is mounted on a cushion. Cloth like layers can be some type of knitted fabric such as a polyester knit or other type of synthetic fiber knit, and the liquid repelling layer can be some type of synthetic material such as a polyurethane coating (e.g., a polyurethane laminate fabric). Such composite fabrics can provide advantages over former seat covers by providing a soft and comfortable touch to the skin, unlike vinyl which sticks to bare skin and results in an annoying "squeak" when a person shifts on the surface, while still providing stain/liquid resistant protection to the upholstered seat cushion. Of course, many other fabric sheet materials can be utilized including those materials known to one skilled in the art.

The shape of the fabric sheet utilized in a seat cover can take on any number of shapes. In many embodiments, the sheet is a quadrilateral shape with four corners suited for covering the typical seating area of a cushioned upholstered chair, such as a square or rectangle. In some embodiments, the fabric sheet is trapezoidal shape, which can facilitate the sheet's binding with a cushion of an upholstered chair having a solid back support; the shape can hinder bagging or gapping when the sheet is folded and wrapped around the seat cushion in comparison to prior art covers having a square shape. In one embodiment, shown in FIG. 1, the trapezoidal shaped sheet 1 has a shorter side 4 and a longer side 5 that are parallel to each other, connected by two other non-parallel sides 6. The shorter side 4 can be oriented along the back of a chair, while the longer side 5 can be oriented with the front of the chair. As an example, the shorter side can be about twenty inches in length and the longer side can be about twenty-five inches in length.

The straps of the seat cover can be oriented in any number of ways with the fabric sheet. In some instances, a strap can be aligned with a corner of the fabric sheet. For instance, as shown in FIG. 1, each strap 2, 3 extends from a corner of the fabric sheet 1. As well, in some embodiments, it can be advantageous for the strap to extend from the sheet in a manner such that the strap is not aligned with (e.g., substantially parallel or collinear with) a side of the fabric sheet. For instance, as shown in FIG. 1, a strap 3 does not extend along the same direction as either edge 5, 6 that forms the corner from which the strap 3 extends. Instead, the strap 3 extends to form two approximately equal angles with the sides of the fabric. Such an orientation can help the straps bind the fabric sheet to the seat cushion when the straps have a substantial width as shown in FIG. 1.

The sizes of the fabric sheet and straps can be any desired. In some embodiments, it can be advantageous to utilize a fabric sheet with an area that is larger than the area of the cushion to be covered by the seat cover. This allows most if not all of the cushion's surface to be protected by the seat cover when the cover is draped over the cushion and its sides. For instance, in some embodiments the fabric area can be in the range of about five-hundred to about eight-hundred square inches. It is understood that seat areas that are substantially the same area as the sheet, or even larger, can also potentially utilize the seat cover. With regard to the straps, the straps should have a sufficient length that they can be wrapped around a seat cushion (e.g., about ten to about thirty inches in length). It is advantageous to have the straps provide enough tension to slightly stretch the fabric to conform the sheet shape to the shape of the cushion.

Figure 2C:
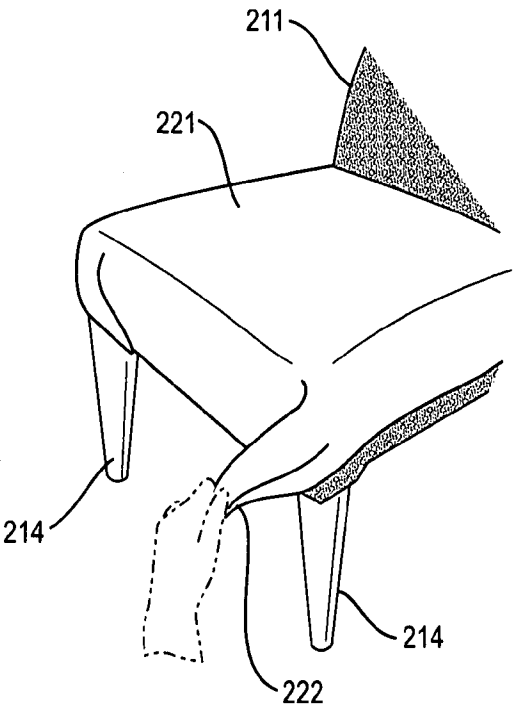
FIGS. 2A-2E depict various views of a seat cover being mounted on an upholstered chair consistent with embodiments of the present invention.
Figure 2B:
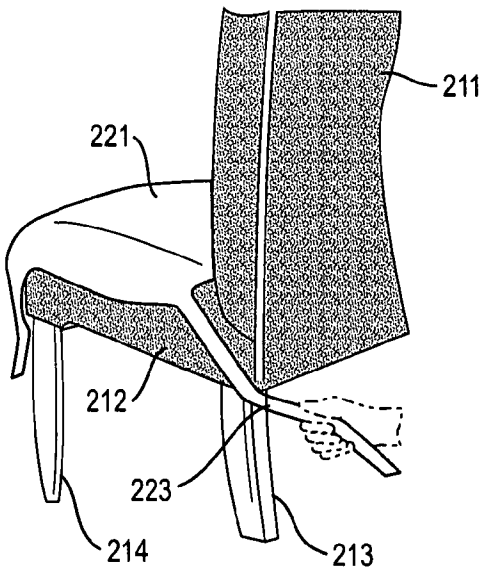
Figure 2A:
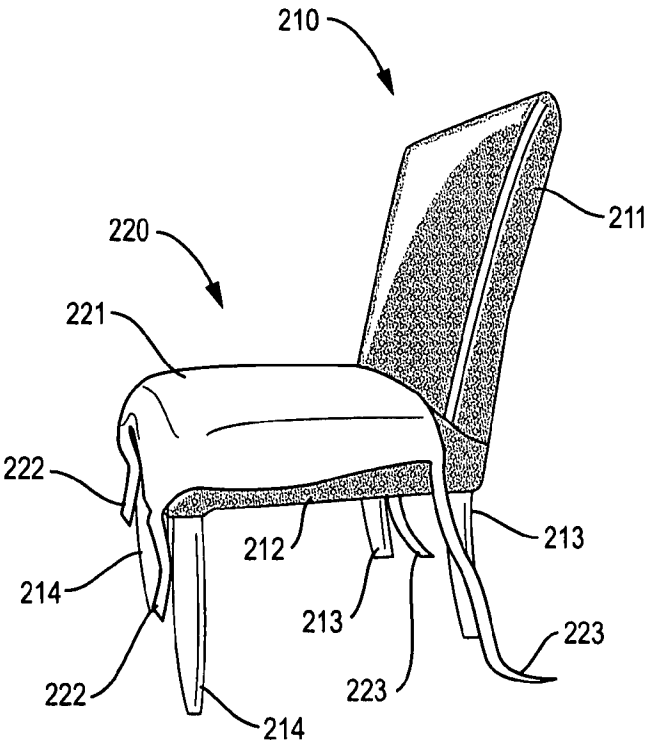

In some embodiments, the straps are sized such that two straps are substantially shorter than two other straps. One depiction of such an embodiment is shown in FIG. 1, where two straps 2 are substantially longer than two other straps 3. For example, the shorter straps can be about ten inches in length and the longer straps can be about twenty inches in length. As shown in FIG. 1, in some instances the two longer straps 2 are adjacent one another, and the two shorter straps 3 are adjacent one another. Such embodiments can facilitate binding of the seat cover to a cushion of an upholstered chair. For instance, when the upholstered chair has a solid backing, as shown in FIG. 2A, the side of the fabric with the longer straps can be positioned along the back edge of the chair. The longer straps can help in positioning the straps around the back legs and under the seat. The shorter straps, which can be oriented with the front edge of the seat, are extended between the front legs and need not have the extra length. It is understood, however, that these are some embodiments of the invention, and such strap length and/or position limitations are not necessarily present in other embodiments.

For embodiments of the invention that utilize a connector, or other methodology, with a strap for connecting one strap with another, any number of mechanisms can be utilized to allow straps to connect with one another. In some embodiments, the connector is a structure in which a strap is not tied to the connector (e.g., the connector is sewed, adhered, or otherwise attached to a strap). In some instances, connectors can have complementary configurations such that a "male" connector can only attach to a "female" counterpart. For instance, with a hook and loop connector (e.g., Velcro®) as utilized in FIG. 1, a connector with the softer threaded section 8 will only attach to a connector having the plastic hook-like structures 9. In some embodiments, straps associated with the back legs of the chair will have complementary connectors relative to the straps associated with the front legs, i.e., the connectors of the straps of the back legs will not attach to one another and/or the connectors of the straps of the front legs will not attach to one another. For example, connectors 8 of straps 2 will only attach with connectors 9 of straps 3 as shown in FIG. 1. In other embodiments, the connector associated with a strap of one corner will be attachable to the connector of a strap in one adjacent corner while not being attachable to the connector of a strap in the other adjacent corner. For instance, with regard to FIG. 1, each strap 2 with connector 8 will attach to one adjacent strap 3 with connector 9 but not with the other adjacent strap 2 with connector 8. Also or alternatively, as exemplified in FIG. 1, in some instances, the connectors 8 associated with longer straps 2 will be complementary with the connectors 9 of the shorter straps 3.

While the non-limiting example in FIG. 1 utilizes hook and loop connectors 8, 9, other connectors can be utilized with embodiments such as snap buckle mechanisms, hooks, spring-loaded closures, and other mechanisms including those known to a skilled artisan. For instance, a snap buckle mechanism can include two complementary pieces in which a male insert can be slid into a female acceptor and snapped together. Obviously, the connectors to be used in accord with embodiments of the present invention need not be just hook and loop connectors. As well, other embodiments may utilize connectors that do not have complementary counterparts (e.g., hooks that can be substantially similar in shape and capable of engaging one another).

Straps of the seat cover can also include other features that can help adjust the effective length for helping tightened the strap to bind the fabric sheet to the cushion of an upholstered chair. Mechanisms for adjusting the length of a seat cover can be implemented on one or more straps such as a strap threader on a snap buckle or other apparatus including those known to one skilled in the art. The mechanism can either be pre-adjusted such that attached straps are in tension upon connecting the straps, or the mechanism can be adjusted after the straps are attached (e.g., pulling on a loose end of a strap) to adjust the tension of the connected straps.

Methods of Protecting Furniture

Some embodiments of the invention are directed to methods of protecting furniture, such as upholstered chairs. In some instances, these methods can utilize a seat cover as described by one or more embodiments within the present application. It is understood, however, that these methods do not necessarily require a seat cover as described in the present application.

In some particular embodiments, a seat cover is used to protect an upholstered seat of a chair. The chair can be a four-legged chair, which can include a cushioned seat that can have a thickness such that the seat cover is capable of being bound around the entire seat (e.g., a dining room chair sized cushion as opposed to a living room chair with a seat base that extends to within six inches of the floor). One example of such a chair 210 is depicted in FIGS. 2A-2E. The chair 210 can have a back support 211 an upholstered seat 212, two back legs 213 (e.g., legs that are each aligned along a side of the back support), and two front legs 214 (e.g., legs that are positioned along the front edge of the upholstered seat).

A seat cover can be used to protect and cover the upholstered seat. In some instances, the seat cover can include a liquid-resistant fabric having an area sufficient to substantially cover the seat area of a cushion of the upholstered seat. The seat cover can also include four or more straps that are each attached to fabric. Each strap can have a free-end and/or a connector configured to attach to at least one other strap (e.g., via the other strap's connector). For the specific embodiment shown in FIGS. 2A-2E, the seat cover 220 has a trapezoidal shaped sheet 221 in which the shorter side is oriented along the back edge of the seat cushion 212 (i.e., aligned substantially with the bottom of the back support 211) and the longer side is oriented along the front edge of the seat cushion. The seat cover 220 is positioned to cover the seat area of the upholstered seat.

Figure 2E:
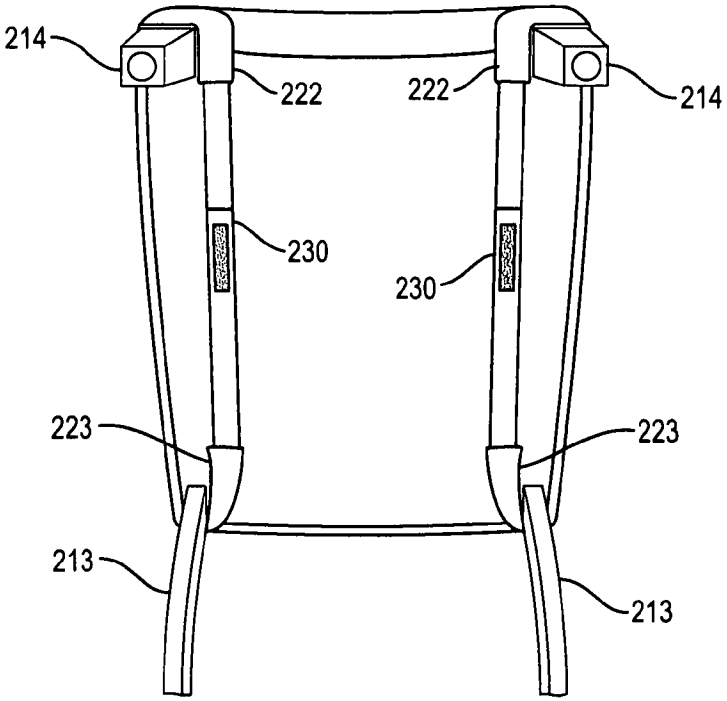
Figure 2D:
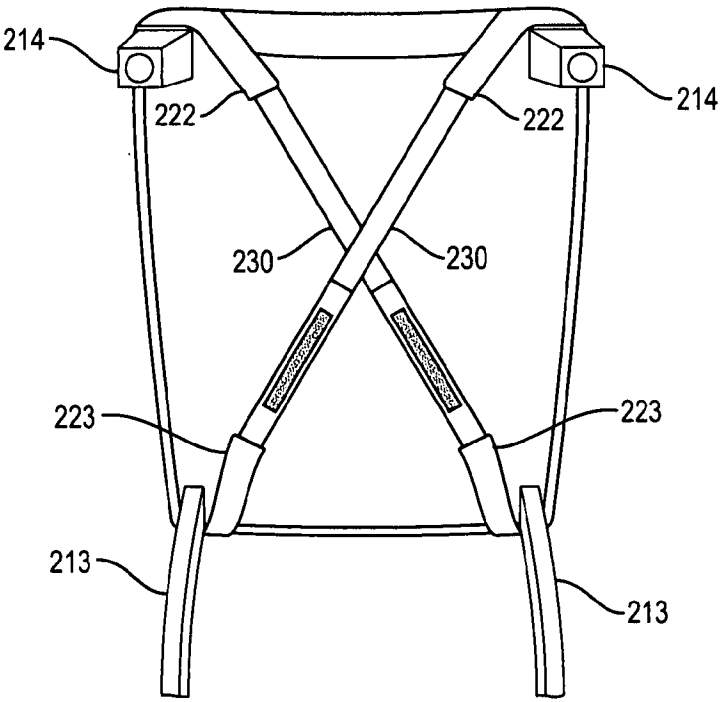
Figure 3A:
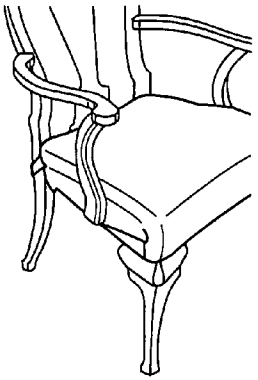
FIG. 3 depicts perspective views of seat covers, consistent with embodiments of the present invention, mounted on different types of upholstered chairs.
Figure 3B:
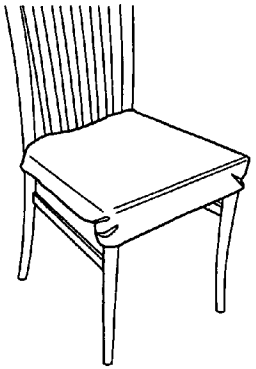
Figure 3C:
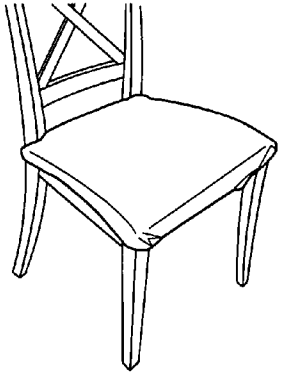
Figure 3D:
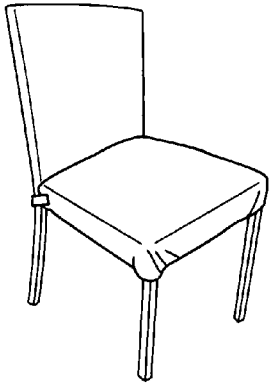
Figure 3E:
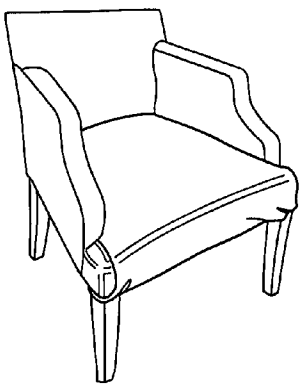
Figure 3F:
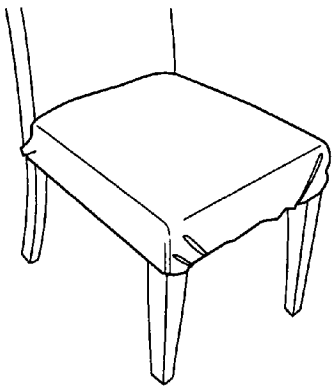
Figure 3G:
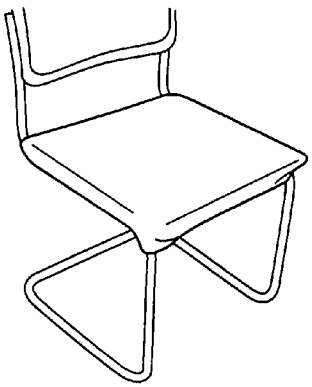

After positioning the seat cover to cover the seat area of the upholstered seat, the straps are positioned under the upholstered seat and connected. For example, as shown in FIG. 2B, the back straps 223 are each wrapped around a chair leg 213 and down under the seat cushion 212. As well, as shown in FIG. 2C, front straps 222 are pulled into tension. Excess fabric sheet 221 is folded and the front strap 222 is extended between the front legs 214 of the chair as shown in FIGS. 2C-2E. In the embodiments corresponding with FIGS. 2A-2E, each strap has a hook and loop connector 230 (e.g., Velcro®). The corresponding connectors are attached to one another while substantially simultaneously adjusting the tension of the attached straps 222, 223, giving the fabric 221 a stretched and form fitting configuration on the upholstered seat 212. When the fabric area is large enough, the fabric also substantially covers the sides of the upholstered seat as well. Accordingly, the use of connectors of this type can make securing of the fabric much easier, as well as resulting in better binding of the fabric to the cushion, relative to prior art devices that require a central hub mechanism in which straps are tied to the hub under the seat or tying straps to the legs of a chair.

As described above, other connectors can be used on seat covers consistent with embodiments of the present invention. In some cases, the connectors do not allow for substantially simultaneous attachment of the straps with adjustment of the tension of the attached straps, and these steps can be performed in series. For instance, with a snap buckle mechanism, the straps can be attached together first by inserting the male piece into the female acceptor, then the straps can be placed in tension by pulling on the threaded loose strap(s). Alternatively, the strap length can be pre-adjusted so that when the snap buckle is put together, the straps are in tension. Accordingly, in some embodiments, the order in which the attachment of straps and the adjustment of straps need not be in a particular manner.

Seat covers that utilize straps that attach to one another in some direct manner, to provide tension between connected straps, can show distinct advantages relative to straps that are tied to chair legs or tied to some central mechanism positioned under a seat. The straps are easier to connect and provide a tighter fitting for the cover to the upholstered seat, resulting in a more tailored and appealing look that fits a wide range of cushion sizes and shapes. As well, the shifting and sliding of the seat cover and the unsightly gapping and bagging that plagued earlier designs are eliminated.

In several embodiments, the front straps 222 can have a connector that only attaches to a connector attached to a back strap 223 (i.e., the front strap connectors will not attach to one another and/or the back strap connectors will not attach to one another). Accordingly, when front straps are connected to back straps, they can be configured to cross each other as shown in FIG. 2D, or to run parallel each other as shown in FIG. 2E. The FIG. 2D configuration, in some instances, can allow for a tighter fit between the fabric sheet 221 and the upholstered seat 212, while the configuration in FIG. 2E may be advantageous when the upholstered seat 212 is relatively large.

While FIGS. 2A-2E illustrate some methods consistent with embodiments of the present invention, it is clear that a number of different types of upholstered chairs can be protected by the techniques described in the present application. FIG. 3 shows various depictions of other chairs that are protected by a seat cover consistent with embodiments of the present invention. Furthermore, the methods described with reference to FIGS. 2A-2E can also be altered in one or more steps to provide other chair covering techniques. For instance, straps can be wrapped around chair legs in directions that differ from those described with reference to FIGS. 2A-2E (e.g., the straps corresponding with the front legs of the chair may be wrapped around the outside of the legs, akin to what is done with the straps associated with the back legs). As well, or in addition, other sized or configured seat covers can be utilized, including any of those described in the present application. Furthermore, additional steps can be taken to help improve the fit or appearance in using seat covers (e.g., tucking the seat cover into the fold between cushions of an upholstered seat as shown in FIG. 3). As well, the seat covers disclosed herein can also be used on other chair types (e.g., non-four legged chairs) and even upholstered benches by attaching two or more seat covers together and binding them to the bench seating area.

EQUIVALENTS

While the present invention has been described in terms of specific methods, structures, and devices it is understood that variations and modifications will occur to those skilled in the art upon consideration of the present invention. As well, the features illustrated or described in connection with one embodiment can be combined with the features of other embodiments. Such modifications and variations are intended to be included within the scope of the present invention. Those skilled in the art will appreciate, or be able to ascertain using no more than routine experimentation, further features and advantages of the invention based on the above-described embodiments. Accordingly, the invention is not to be limited by what has been particularly shown and described, except as indicated by the appended claims.

All publications and references are herein expressly incorporated by reference in their entirety. The terms "a" and "an" can be used interchangeably, and are equivalent to the phrase "one or more" as utilized in the present application. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. A method of protecting an upholstered seat of a chair, comprising:

providing a seat cover comprising:

(a) a liquid-resistant fabric having an area sufficient to substantially cover a seat area of a cushion of the upholstered seat; and (b) at least four straps attached to the fabric, each strap having a free-end and a connector configured to attach to at least one other strap;

covering the seat area of the cushion with the area of the fabric;

positioning each of the at least four straps under the upholstered seat of the chair;

attaching each of the at least four straps to the at least one other strap using the connectors of each of the attached straps; and adjusting at least one strap such that attached straps are in tension, the method resulting in the fabric being stretched over the cushion of the upholstered seat to hinder relative movement between the fabric and cushion when a person is seated on the fabric and cushion, wherein the chair comprises a back support, a pair of back legs each elongatedly aligned with a side of the back support, and a pair of front legs, further wherein the step of positioning comprises (i) wrapping at least a portion each of at least two straps outside a corresponding back leg of the chair, and (ii) extending at least a portion of each of at least two straps between the front legs of the chair.

2. The method of claim 1, wherein the step of adjusting is performed before the step of attaching.

3. The method of claim 1, wherein the steps of adjusting and attaching are performed substantially simultaneously.

4. The method of claim 1, wherein each of the at least four straps is aligned with a corner of the fabric.

5. The method of claim 1, wherein each of the at least four straps is not aligned with a side of the fabric.

6. The method of claim 1, wherein the at least four straps each include a hook and loop connector configured to attach to another strap.

7. The method of claim 1, wherein the at least four straps comprise at least two longer straps and at least two shorter straps, the at least two longer straps each being wrapped outside the corresponding back leg, and the at least two shorter straps each being extended between the front legs.

8. The method of claim 7, wherein the fabric comprises a trapezoidal shape having a shorter side and a longer side, further wherein the step of positioning comprises aligning the shorter side of the trapezoidal shape with the back legs of the chair.

9. A method of protecting an upholstered seat of a chair, comprising:

providing a seat cover comprising:

(a) a liquid-resistant fabric having an area sufficient to substantially cover a seat area of a cushion of the upholstered seat; and (b) at least four straps attached to the fabric, each strap having a free-end and a connector configured to attach to at least one other strap;

covering the seat area of the cushion with the area of the fabric;

positioning each of the at least four straps under the upholstered seat of the chair;

attaching each of the at least four straps to the at least one other strap using the connectors of each of the attached straps; and adjusting at least one strap such that attached straps are in tension, the method resulting in the fabric being stretched over the cushion of the upholstered seat to hinder relative movement between the fabric and cushion when a person is seated on the fabric and cushion, wherein the chair comprises a back support, and a pair of back legs each elongatedly aligned with a side of the back support, and wherein the fabric comprises a trapezoidal shape having a shorter side and a longer side, further wherein the step of positioning comprises aligning the shorter side of the trapezoidal shape with the pair of back legs of the chair.

10. The method of claim 9, wherein the at least four straps comprise at least two longer straps and at least two shorter straps, the at least two longer straps each being wrapped outside at least one of the pair of back legs.

11. The method of claim 9, wherein the step of adjusting is performed before the step of attaching.

12. The method of claim 9, wherein the steps of adjusting and attaching are performed substantially simultaneously.

13. The method of claim 9, wherein each of the at least four straps is aligned with a corner of the fabric.

14. The method of claim 9, wherein each of the at least four straps is not aligned with a side of the fabric.

15. The method of claim 9, wherein the at least four straps each include a hook and loop connector configured to attach to another strap.

16. A seat cover for protecting an upholstered seat of a chair, comprising:

a liquid-resistant, four-sided, fabric sheet having an area sufficient to substantially cover a seat area of a cushion of the upholstered seat; and at least four straps attached to the sheet, each of the at least four straps aligned with a corner of the sheet, the corner being adjacent to two other corners, each of the at least four straps having a connector adapted to (a) connect to another connector of a strap at one adjacent corner, and (b) not to connect to another connector of a strap located at another adjacent corner, the sheet configured to be stretched over the cushion when each of the at least four straps are attached to at least one other strap in tension, the at least four straps comprising at least two long straps and at least two short straps, each long strap being longer than each short strap, each connector of the at least two long straps configured to be attachable to the connector of each of the at least two short straps.

17. The seat cover of claim 16, wherein the sheet comprises a non-vinyl material.

18. The seat cover of claim 16, wherein the at least two long straps are each configured to attach to one of the at least two short straps.

19. The seat cover of claim 16, wherein the sheet comprises a trapezoidal shape having a short side and a long side, the short side being shorter than the long side, the at least two short straps being aligned with corners of the long side.

20. The seat cover of claim 16, wherein the sheet comprises a trapezoidal shape.

21. The seat cover of claim 16, wherein the connector of each of the at least four straps comprises a hook and loop connector.

22. An upholstered cushioned chair protected by a covering comprising:

a cushion and the seat cover of claim 16 each of the at least four straps of the seat cover attached to another strap in tension using the connectors each located under a seat area of the cushion, the fabric sheet being stretched over the cushion to substantially cover the seat area and to hinder relative movement between the fabric sheet and cushion when a person is seated on the fabric sheet and cushion.

23. The upholstered cushioned chair of claim 22, wherein the chair comprises a back support, a pair of back legs each elongatedly aligned with a side of the back support, and a pair of front legs, further wherein the at least two long straps are each wrapped outside of a back leg of the chair and the at least two short straps are each extended between the front legs of the chair.

* * * * *